US006648600B2

(12) United States Patent
Takahashi et al.

(10) Patent No.: US 6,648,600 B2
(45) Date of Patent: Nov. 18, 2003

(54) TURBINE ROTOR

(75) Inventors: Yasuo Takahashi, Hitachinaka (JP); Shinya Marushima, Hitachinaka (JP); Shinichi Higuchi, Hitachinaka (JP); Tsuyoshi Takano, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 9 days.

(21) Appl. No.: 10/136,313

(22) Filed: May 2, 2002

(65) Prior Publication Data

US 2002/0182073 A1 Dec. 5, 2002

(30) Foreign Application Priority Data

May 31, 2001 (JP) ..... 2001-163873

(51) Int. Cl.[7] ..... F01D 5/18

(52) U.S. Cl. ..... 416/97 R; 416/96 R; 416/144; 415/115

(58) Field of Search ..... 416/97 R, 96 R, 416/144, 95; 415/115

(56) References Cited

U.S. PATENT DOCUMENTS 4,505,640 A * 3/1985 Hsing et al. ..... 416/97 R
5,593,274 A * 1/1997 Carreno et al. ..... 415/115
5,755,556 A * 5/1998 Hultgren et al. ..... 416/96 R
5,867,976 A * 2/1999 Ziegler, Jr. ..... 60/39.33
6,224,327 B1 * 5/2001 Aoki et al. ..... 415/115

FOREIGN PATENT DOCUMENTS

JP 10-220201 * 8/1998
JP 2001-20759 * 1/2001

* cited by examiner

*Primary Examiner*—Edward K. Look
*Assistant Examiner*—J. M. McAleenan
(74) *Attorney, Agent, or Firm*—Mattingly, Stanger & Malur, P.C.

(57) ABSTRACT

A turbine rotor can fix the heat resisting pipes provided in divided form per the disk member with simple structure for preventing wearing and damaging. The turbine rotor includes a coolant flow path formed through a plurality of disc shaped members respectively stacked across stacking planes in axial direction, a heat resisting pipe divided into a plurality of fractions adapted to be inserted into a portion of the coolant flow path defined in each disc shaped member, spot facing recesses each formed at opening portion of coolant flow path at the same side of the disc shaped member coaxially with the coolant flow path and having greater inner diameter than the opening portion, and ring shaped projecting portions formed at respective end portions of the fractions of the heat resisting pipe and engageable with respective spot facing recesses.

5 Claims, 6 Drawing Sheets

TURBINE ROTOR

BACKGROUND OF THE INVENTION

The present invention relates to a turbine rotor formed by stacking disk shaped members in axial direction, and more particularly to a turbine rotor inserted heat resisting pipes by forming therein coolant flow passages in axial direction.

DESCRIPTION OF THE RELATED ART

In general, a gas turbine in a thermal power generation plant is constructed with a compressor sucking an air (atmospheric air) and compressing up to a predetermined pressure, a combustor mixing the air compressed by the compressor with a fuel and burning for generating a combustion gas, and a turbine portion generating a driving force by expansion of a high temperature and high pressure combustion gas. Also, a gas turbine power generation facility is constructed by providing a generator converting the driving force generated by the turbine into an electric energy.

Amongst, the turbine portion is constructed with a turbine casing mainly housing the entire construction, a combustion gas flow path acting and flowing the combustion gas generated by the combustor, vanes and blades alternately arranged within the combustion gas flow path, and a turbine rotor formed by stacking turbine disks and spacer disks. The vanes are fixed on the inner periphery of the turbine casing and the blades are fixed on the outer periphery of the turbine rotor, respectively.

In the construction of the turbine portion, by flow of the high temperature combustion gas through the combustion gas flow oat, the turbine rotor is driven to rotate at high speed to generate the driving force (shaft rotating force). Accordingly, for obtaining high output by the gas turbine, it is an important point for elevating temperature of the combustion gas and for enhancing efficiency of the gas turbine at the entrance of the turbine portion.

Associating elevated temperature and enhanced efficiency of the gas turbine, it is essential to cool high temperature portion of the gas turbine, such as turbine blades and the combustion has flow path, for certainly attaining reliability of the gas turbine facility. Accordingly, particularly in the turbine blades, a blade cooling system is employed for protecting blade members from heat of the high temperature combustion gas flowing through the combustion gas flow path.

In the blade cooling system, there are some systems which use air extracted at a predetermined pressure from the compressor or a steam extracted from a steam turbine in a combined cycle power plant, development of which has been progressed in the recent years, is used as coolant. Such coolant is fed to each turbine blade through a coolant supply passage provided within the turbine rotor to cool the blades by flowing through the blade cooling path formed within each blade.

On the other hand, in such blade cooling system, as one type depending upon handling method of the coolant after cooling the blade, there is an open cooling system by directly discharging the coolant into the combustion gas flow path through slits or conduits formed in the blades. Since the coolant is discharged into the combustion gas flow passage after cooling the blade, the open cooling system causes lowering of the combustion gas temperature, mixing loss of the coolant and the combustion gas and lowering of performance of the turbine to lower efficiency of the turbine.

Accordingly, in order to improve efficiency of the gas turbine, in order to improve efficiency of the gas turbine, there has been proposed a closed cooling system, in which the coolant after cooling the blades is not discharged into the combustion gas flow path but is connected in the combustion chamber of steam turbine via a coolant recovery path provided within the turbine rotor.

As the conventional construction of the blade cooling system in such closed cooling system, there is a system disclosed in Japanese Patent Application Laid-Open No. Heisei 10 (1998)-220201, for example, in which coolant supply paths for supplying the coolant to the blades and coolant recovery paths for collecting coolant after cooling the blades (hereinafter, both are generally referred to as coolant flow path) are formed through the inside of the turbine rotor in axial direction, namely, provided perpendicularly intersecting with each disk shaped member and the stacking plane as mating surfaces of the disk shaped members.

On the other hand, in Japanese Patent Application Laid-Open No. Heisei 10-220201, there has been disclosed a construction for inserting the heat resisting pipes within the inside of the coolant flow paths with dividing per each disk shaped members. By this, thermal influence to each disk shaped member by flow the coolant can be reduced.

However, the following problems are encountered in the prior art.

In the construction of the turbine rotor as set forth above, the turbine disks carrying the blades on the outer periphery and the spacer disks disposed between the turbine disks are stacked, and a stacking bolt extends through perpendicularly to stacking planes. Even the coolant flow paths to flow the coolant, they are formed perpendicularly to respective stacking planes and extend therethrough. Accordingly, in relation to certainty of coupling of the turbine rotor and to sealing ability of the coolant flow paths, it is ideal in design that turbine disks and the spacer disks are tightly fitted with each other on the stacking planes without gaps.

However, when both of the coolant supply paths and coolant recovery paths are admixingly present in the turbine disks and the spacer disks, a temperature of the coolant in the coolant supply paths is about 250 C whereby a temperature absorbing temperature of the blade members is elevated as high as 500 C to cause thermal stress in the component members of the turbine disks and the spacer disks to cause non-uniform thermal deformation. This causes gaps in the stacking planes between the disk shaped members to be a cause of leakage of the coolant to the stacking planes. Due to leakage to the stacking planes, predetermined flow rate of coolant to the turbine blades cannot be certainly supplied to cause degradation of reliability and durability of the blade members.

The heat resisting pipes disclosed in Japanese Patent Application Laid-Open No. Heisei 10-220201 are for reducing thermal stress to be caused in respective disk shaped members due to temperature difference between the supply paths and the collecting paths of the coolant as set forth above. By inserting the heat resisting pipe having smaller internal diameter into respective coolant flow paths for reducing thermal influence to the external disk shaped member from the inside of the pipes.

On the other than, on the stacking surface, due to precision in production, since positions of forming the coolant flow paths between respective disk shaped members can be offset in circumferential direction and radial direction, it becomes necessary to make the external diameter of the heat resisting pipes small when single long heat resisting pipe is inserted through respective coolant flow paths. However, in the coolant flow paths in each disk shaped member, the gap is formed between the external diameter of the heat resisting pipe and the internal diameter of the coolant flow path. This gap may cause extra stress on the heat resisting pipe during operation to lower durability of the heat resisting pipe. Therefore, a problem is encountered in inserting single long heat resisting pipe. Furthermore, since the heat resisting pipe transports the coolant for cooling the blade, it is abruptly heated in comparison with each disk member to cause displacement of the heat resisting pipe in axial direction due to thermal elongation. Then, by centrifugal force developed by rotation of the rotor, the heat resisting pipe and the inner periphery of the coolant flow path contact to cause wearing in the heat resisting pipe due to displacement in the axial direction of the heat resisting pipe on the contact surface. As set forth above, when one long heat resisting pipe is installed, displacement of the heat resisting pipe in axial direction becomes large at the end portion thereof to increase wearing of the heat resisting pipe in the contacting surface with each disk shaped member. Increase of wearing can be a factor for decreasing life period of the heat resisting pipe. Accordingly, concerning the heat resisting pipe inserted into the coolant flowpath, a construction to insert with dividing per disk shape member is frequently employed as shown in FIG. 2 of Japanese Patent Application Laid-Open No. 10-220201 and so forth.

However, when the heat resisting pipe is inserted with divided per each disk shaped member, each heat resisting pipe inherently becomes small member to easily cause movement or rotation in axial direction or about axis in the heat resisting pipe per se during operating revolution of the turbine rotor to severe wearing and damage to be problem in durability.

On the other hand, in view of the precision in production, it is difficult to form the stacking plane with high flatness to completely eliminate the gap. Furthermore, even due to fluctuation of flatness of the stacking plane or fluctuation of tightening force of the stacking bolt, local gap in the circumferential direction is cased in the stacking plane between the turbine disk and the spacer disk. When even a little gap is formed, the coolant on the side of the supply path has higher pressure in comparison with the collection path side to cause leakage of the coolant from the supply path to the collection path for causing thermal unbalance in circumferential direction in the spacer disk. This thermal unbalance increases vibration of the rotor body.

When the heat resisting pipe is provided in divided form as set forth above, thermal stress and thermal deformation of the disk can be slightly reduced, it is not possible to prevent formation of the gap in the stacking plane due to fluctuation of flatness of the stacking plane or fluctuation of tightening force of the stacking bolt. Furthermore, as set forth above, each divided heat resisting pipes causes movement upon operating revolution of the turbine portion to cause leakage of the coolant into the gap in the stacking plane from joint portion of the divided heat resisting pipes to easily cause thermal unbalance.

On the other hand, the foregoing two problems, it is required to provide a structure for fixing each heat resisting pipe and a structure for preventing leakage of the coolant per each stacking plane. However, when these structures are provided individually, the processing portions on the surface of each disk surface is increased to be complicate shape to easily cause concentration of stress to be not desirable in view point of strength.

SUMMARY OF THE INVENTION

A first object of the present invention is to provide a turbine rotor which can fix the heat resisting pipes provided in divided form per the disk member with simple structure for preventing wearing and damaging.

A second object of the present invention is to provide the turbine rotor which can minimize leakage of coolant to the stacking plane by using the fixing structure of the heat resisting pipe.

In order to accomplish the first object, according to the first aspect of the present invention, a turbine rotor comprises: a coolant flow path formed through a plurality of disc shaped members respectively stacked across stacking planes in axial direction; a heat resisting pipe divided into a plurality of fractions adapted to be inserted into a portion of the coolant flow path defined in each disc shaped member; spot facing recesses each formed at opening portion of coolant flow path at the same side of the disc shaped member coaxially with the coolant flow path and having greater inner diameter than the opening portion; and ring shaped projecting portions formed at respective end portions of the fractions of the heat resisting pipe and engageable with respective spot facing recesses.

By providing the spot facing recess in the opening portion of the coolant flow path, and by providing the ring shaped projecting portion engageable with the spot facing recess at the end of the heat resisting pipe for engaging with the spot facing recess to be restricted movement in diametrical direction. Also, the ring shape projection is sandwiched by two disk shaped members. Therefore, even during operating revolution of the turbine rotor, the heat resisting pipe is fixed in diametrical direction and axial direction to prevent wearing and damaging.

In the construction set forth above, it is preferred that each of the ring shaped projecting portions is formed with a cut-out step portion on the side of the stacking plane for receiving therein an annular seal member.

By providing special machining for the disc shaped member, for providing the seal structure exclusively using the fixing structure on the side of the heat resisting pipe, increasing of stress concentration by machining can be avoided and leakage of the coolant from the coolant flow path to the stacking plane can be reduced.

Preferably, a material of the heat resisting pipe has greater linear thermal expansion coefficient than that of a material of the disk shaped member.

By this, during high temperature state in operation of the turbine portion, the heat resisting pipe causes thermal expansion to be elongated in axial direction in greater magnitude than the disc shaped member. By this, the annular seal disposed between the ring shaped projecting portion and the stacking plane mating to the former is compressed to increase sealing performance to minimize leakage of the coolant.

It is further preferred that at least two projecting ridges are provided on outer periphery of the ring shaped projecting portion, and back facing grooves engageable with the projecting ridges are formed on the inner periphery of the spot facing recess at circumferential positions corresponding to positions of the projecting ridges.

By this, the heat resisting pipe is fixed in circumferential direction to prevent wearing and/or damaging.

Also, in the preferred construction, engaging projecting portions having smaller inner diameter than that of the coolant flow path is formed the end of the heat resisting pipe on opposite side of the end where the ring shaped projecting portion is provided, the engaging projecting portions is located in an opening portion of the coolant flow path on the stacking plane of the disc shaped member on opposite side of the stacking plane where the spot facing recess is formed.

By this, even when crack is formed in a part of the heat resisting pipe to result in rapture, the separated piece or debris is prevented from loosing off for avoiding unbalance vibration due to offset of the gravity center of the disc. On the other hand, damaging of other member by loosed off debr4is can be prevented to improve reliability.

According to the second aspect of the present invention, a turbine rotor comprises: a coolant flow path formed through a plurality of disc shaped members respectively stacked across stacking planes in axial direction; a heat resisting pipe inserted through the coolant flow path; a ring shaped projecting portion provided on the heat resisting pipe; and a hole portion provided in the coolant flow path at a stacking plane of the disk shaped members and engageable with the ring shaped projecting portion at the end of the heat resisting pipe.

According to the third aspect of the present invention, an assembling method of a turbine rotor comprises the steps of: forming a coolant flow path through a plurality of disc shaped members respectively stacked across stacking planes in axial direction; inserting a heat resisting pipe in the coolant flow path; providing a ring shaped projecting portion in the heat resisting pipe; providing a hole portion in the coolant flow path on the stacking plane of the disc shaped member; and inserting the heat resisting pipe into the coolant flow oath with engaging the ring shaped projecting portion of the heat resisting pipe with the hole portion.

According to the fourth aspect of the present invention, a cooling method for cooling a high temperature portion of a gas turbine comprises the steps of: forming a coolant flow path through a plurality of disc shaped members respectively stacked across stacking planes in axial direction; inserting a heat resisting pipe in the coolant flow path for flowing a coolant through the coolant flow path; providing a ring shaped projecting portion in the heat resisting pipe; providing a hole portion in the coolant flow path on the stacking plane of the disc shaped member; and inserting the heat resisting pipe into the coolant flow oath with engaging the ring shaped projecting portion of the heat resisting pipe with the hole portion whereby for flowing coolant through the coolant flow path.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings.

DESCRIPTION OF THE PREFERRED EMBODIMENTS

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structure is not shown in detail in order to avoid unnecessary obscurity of the present invention.

Hereinafter, mode of implementation of the present invention will be discussed with reference to the drawings.

Figure 1:
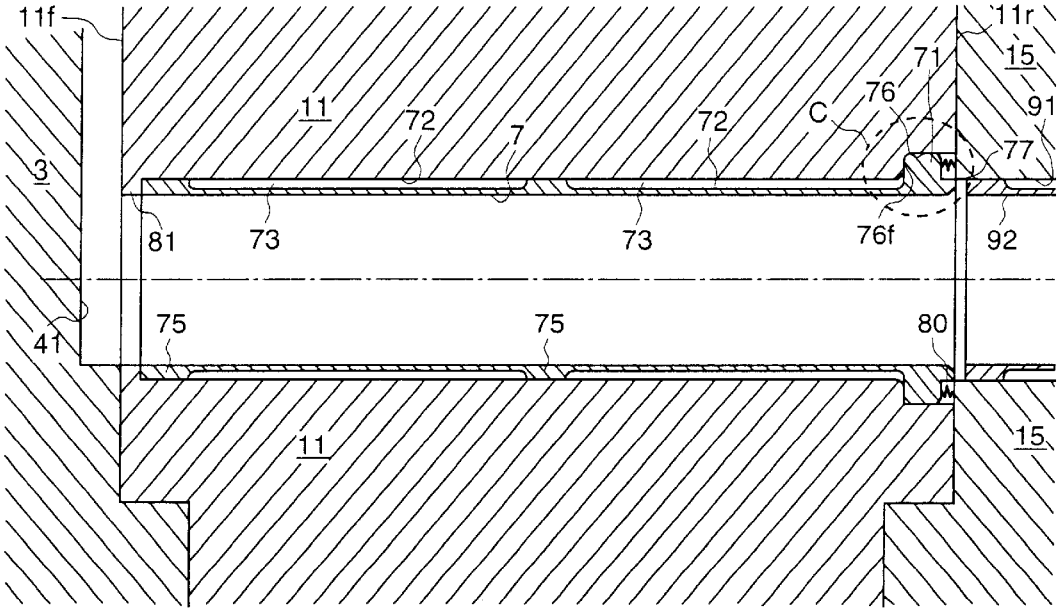
FIG. 1 is enlarged an illustration of a section in axial direction of a coolant supply passage having a heat resisting pipe in a first stage turbine disk of the first embodiment of a turbine rotor according to the present invention.

FIG. 1 is an illustration showing an axial section of a coolant supply path having a heat resisting pipe within a first stage turbine of the first embodiment of a turbine rotor according to the present invention. It should be noted that the axial direction in hereinafter commonly refers to an axial direction of the overall turbine rotor and axial direction of a coolant supply path per se, which are in parallel relationship with each other. On the other hand, a radial direction refers to a radial direction of the coolant supply passage per se. On the other hand, in the drawing, left side (upstream side of flow direction of not shown combustion gas) is referred to as front side and right side is referred to as rear side.

In FIG. 1, the reference numeral 11 denotes a first stage turbine disk, the elements 3 and 15 coupled with stacking planes 11*f* and 11*r* on front side and rear side are a distant piece 3 and a spacer disk 15 between the first stage and a second stage. In the first turbine disk, a coolant supply path 7 is formed piercing in the axial. Within the inner periphery 72 of the coolant supply path, a heat resisting pipe 70 and an E-shaped seal member 80 are provided. On the other hand, even in the spacer disk 15 between the first stage and the second stage, the coolant supply path 7 is arranged substantially in alignment. Within an inner periphery 91, a heat resisting pipe 92 is provided.

The first stage turbine disk 11 is a disk shaped member having first stage blade 21 which will be discussed later, on the outer periphery, which is disposed between the distant piece 3 and the spacer disk 15 between the first stage and the second stage respectively contacting on the front side and the rear side and is firmly fixed thereto by the stacking bolt which will be discussed later. In an opening portion on front side of the coolant supply path 7 extending through the axial direction, a projecting step portion 81 having smaller diameter than outer diameter of the front end portion of the heat resisting pipe 70, is formed. In the opening portion on the opposite rear side, a spot facing recess 76 having greater inner diameter than the coolant supply path 7 is coaxially formed.

Most of the body of the heat resisting pipe 70 is a substantially cylindrical pipe member having an outer diameter smaller than an inner diameter of the inner periphery 72 of the coolant supply path 7. At two portions of the front end portion and an intermediate position in the axial direction, engaging projecting portions 75 having outer diameter tightly engageable with the coolant supply path 7 are formed. On the other hand, on the rear end of the heating resisting pipe 70, a ring shaped projecting portion 71 tightly engageable with the spot facing recess 76 of the first turbine disk 11, is formed. Furthermore, in the outer peripheral portion of the ring shaped projecting portion 71, a cut-out step portion 77 having smaller outer diameter is formed.

On the other hand, in a condition where the heat resisting pipe 70 is completely inserted into the first stage turbine disk 11, the front end portion contacts with the projecting step portion 71, and in conjunction therewith, the ring shaped projecting portion 71 is received within the spot facing recess 76 with tightly engaging therewith. Furthermore, in a condition where the spacer disk 15 between the first stage and the second stage is stacked on the first stage turbine disk 11, the ring shaped projecting portion 71 is arranged in opposition to the front stacking plane of the spacer disk 15 between the first stage and the second stage in proximity thereof.

The E-shaped seal 80 is an annular seal member taking a metal having relatively large resiliency as a material. Overall shape thereof is annular shape which can be installed in the cut-out step portion 77, and cross sectional shape is processed into a shape of E of alphabetic character. On the other hand, the cross-sectional shape of E-shape is formed into a shape opening toward inner periphery side. In the condition set in the cutout step portion 77, it can be elastically expanded and contracted in response to a force exerted in axial condition. When force is not applied in axial direction, a width in the axial direction of the E-shaped seal member 81 (thickness) is relatively greater than the width in axial direction of the cut-out step portion 77. Therefore, upon coupling of the turbine rotor shown in FIG. 1, the rear side portion of the E-shaped seal member 80 slightly project from the rear end portion of the heat resisting pipe 70 to contact with the front stacking plane of the spacer disk 15 between the first stage and the second stage.

The spacer disk 15 between the first stage and the second stage is a disc shaped member arranged between the first stage turbine disc 11 and the second stage turbine disk which will be discussed later and is stacked with these turbine discs in axial direction and firmly coupled by the stacking bolt. On the other hand, the spacer disk 15 between the first stage and the second stage has a construction including the heat resisting pipe 70 having the ring shaped projecting portion 71 and the E-shaped seal member 80 similarly to the first stage turbine disk 11 except that the projecting step portion is not provided in the front opening portion of the coolant supply path 7.

The disc piece 3 is coupled with stacking on the front stacking place of the first stage turbine disc 11, and is connected with a not shown compressor rotor in further front side. On the other hand, on the rear stacking plane, a slit 41 communicated with the coolant supply path 7 of the first turbine disc 11 extends toward the outer periphery.

It should be noted that as a procedure in assembling the turbine rotor, at first, the distant piece 3 is taken as the base, the first stage turbine disc 11 positioned at the most front side, the spacer disc located at the back side thereof and the turbine disc 11 are stacked in sequential order and a stub shaft 2 is finally stacked. Thereafter, a plurality of stacking bolts distributed uniformly is inserted therethrough for firmly coupling. With such assembling process, the heat resisting pipe 70 inserted into respective disc shaped members is always inserted from back side either in supply side or in collection side. Thus, the spot facing recess 76 and the ring shaped projecting portion 71 are inherently positioned on the rear side.

On the other hand, in the shown embodiment, as material for the turbine disc and the spacer disc, high chrome steel is used and as a material of the heat resisting pipe 70 (including the ring shaped projecting portion 71), nickel-base forged super alloy.

Figure 2:
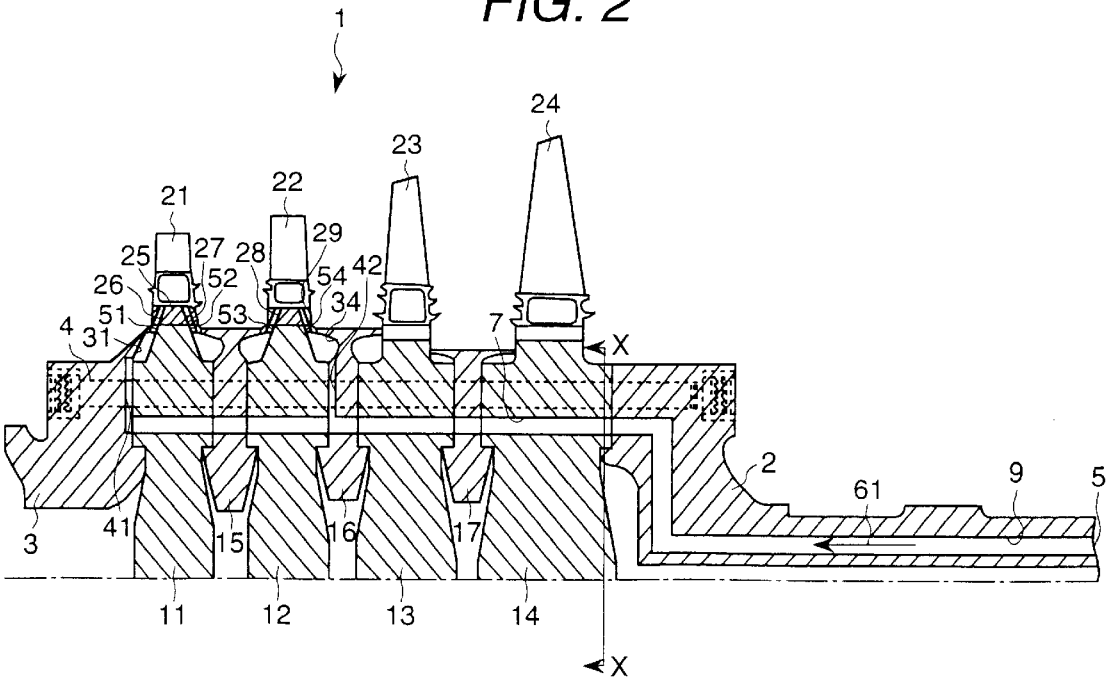
FIG. 2 is a section in axial direction matching with a circumferential direction of one of coolant supply paths in the first embodiment of the turbine rotor.
Figure 3:
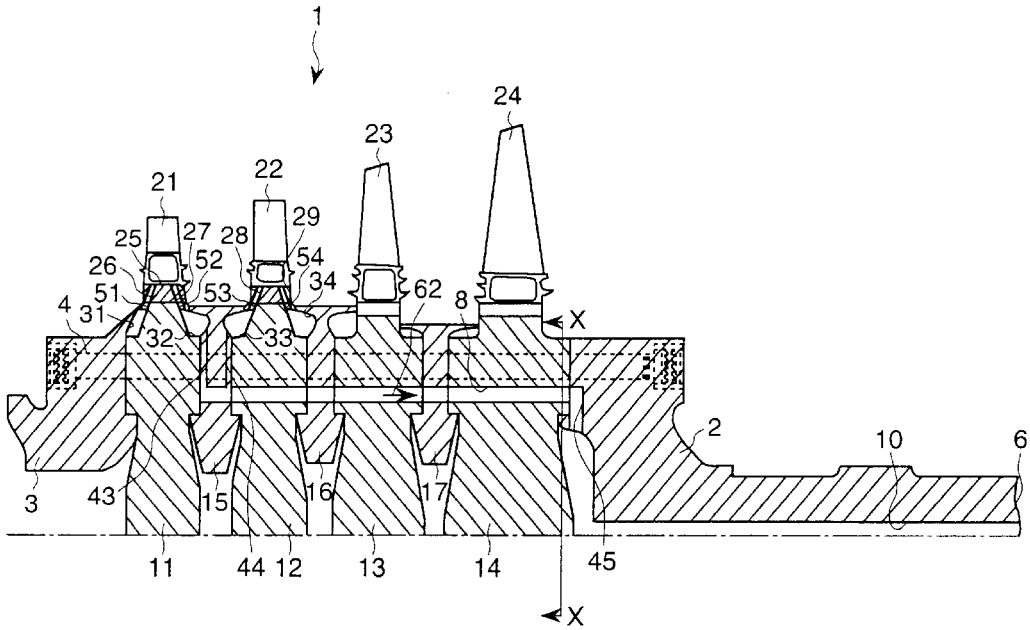
FIG. 3 is a section in axial direction matching with a circumferential direction of one of coolant recovery paths in the first embodiment of the turbine rotor.

FIGS. 2 and 3 are section in axial direction of a construction having both of coolant supply path and coolant recovery path (hereinafter both being generally referred to as coolant flow path) in the embodiment of the turbine rotor according to the present invention. FIG. 2 matches in the peripheral direction with one of the coolant supply paths, and FIG. 3 is a section in axial direction matching in peripheral direction with one of the coolant recovery paths. It should be noted that in order to avoid complexity in illustration in FIGS. 2 and 3, the heat resisting pipe and construction of circumference thereof are eliminated.

In FIG. 2, the reference numeral 1 denotes the turbine rotor. The turbine rotor 1 is constructed with first stage to fourth stage of four turbine discs 11, 12, 13 and 14, spacer discs 15, 16 and 17 disposed between the turbine discs, the stub shaft 2 as rear side surface of the fourth stage turbine disc 14 as turbine shaft end, and a distant piece 3 arranged front side surface of the first stage turbine disc 11 and is connected with a rotor of the not shown compressor. These are firmly fastened by total eight stacking bolts 4 uniformly arranged in circumferential direction.

On the outer periphery of the turbine discs 11, 12, 13 and 14, first stage blade 21, second stage blade 22, third stage blade 23 and fourth stage blade 24 are installed via dovetails 25. Amongst, in the first stage blade 21 and the second stage blade 22, not shown blade cooling passages are formed within the blades.

The coolant supply path 7 is communicated with a coolant supply port 5 and axially extends through the stub shaft 2, the fourth stage turbine disc 14, the spacer disc 17 between the third stage and the fourth stage, the third stage turbine disc 13, the spacer disc 16 between the second stage and fourth stage, the second turbine disc 12, the spacer disc 15 between the first stage and second stage, and the first stage turbine disc 11. Total eight coolant supply paths 7 are uniformly arranged in circumferential direction.

The coolant supply paths 7 formed through the first stage turbine disc 11 are communicated with a cavity 31 formed on the outer periphery side between the first turbine disc 11 and the distant piece 3 through slits 41 formed in the rear side stacking plane of the distant piece 3. The cavity 31 is communicated with not shown blade cooling passages formed within the first stage blade 21 via supply holes 51 formed in the outer periphery of the first stage turbine disc 11 and introduction port 26 formed in the dovetail 25 of the first stage blade 21.

On the other hand, similarly, even for the second stage blade 22, the coolant supply path 7 formed through the spacer disc 16 between the second stage and the third stage are communicated to a cavity 34 formed on the outer periphery side between the spacer disc 16 between the second stage and the third stage via the slits 42 formed on the front side stacking plane. The cavity 34 is communicated with the not shown blade cooling passages formed in the second stage blade 22 via the supply holes formed on the outer periphery of the second stage turbine disc 12 and the introduction port 29 formed in the dovetail 25 of the second stage blade 22.

In FIG. 2, as a process that the coolant 61 is supplied to the first stage blade 21 and the second stage blade 22, the coolant 61 supplied from the coolant supply port 5 enters into respective cavities 31 and 34 from the slits 41 provided on the rear stacking plane of the distant piece 3 and the slits 42 provided on the front stacking plane of the spacer disc 16 between the second stage and the third stage through the supply path 9 in the stub shaft and the coolant supply path 7. The coolant 61 flows into the not shown blade cooling passages respectively formed within the first stage blade 21 and the second stage blade 22 via the supply conduits 51 and 54 from the cavities 31 and 34 and the introducing ports 26 and 29 to circulate for cooling respective blades.

Next, in FIG. 3, the coolant recovery path 8 is formed through the spacer disc 15 between the first stage and the second stage, the second stage turbine disc 12, the spacer disc 16 between the second stage and third stage, the third stage turbine disc 13, the spacer disc 17 between the third stage and fourth stage and the fourth stage turbine disc 14. Total eight coolant recovery paths 8 are uniformly distributed in circumferential direction and are alternately arranged with the coolant supply paths 7 in FIG. 2. In addition, for the portions equivalent to those shown in FIG. 2 will be identified by the same reference numerals and discussion therefor will be eliminated.

The coolant 62 cooled the first stage blade 21 is introduced into a cavity 32 formed on the outer periphery side between the first turbine disc 11 and the spacer disc 15 between the first stage and second stage through discharge ports 27 formed in the dovetail 25 of the first stage blade 21 and collection holes 52 of the first stage turbine disc 11. The cavity 32 and the coolant recovery path 8 are communicated through slits 43 formed on the front stacking plane of the spacer disc 15 between the first stage and second stage. The coolant 62 after cooling the blades flows into the coolant recovery paths 8 from the cavity 32 through the slits 43. The coolant 62 passed through the coolant recovery paths 8 is discharged from the coolant recovery port 6 via the slits 45 formed on the front stacking plane of the stub shaft 2 and through the collecting passages 10 in the stub shaft formed in the axial center portion in the stub shaft 2.

On the other hand, similarly, the coolant 62 cooled the second stage blade 22 is introduced into a cavity 33 formed on outer periphery side between the spacer disc 15 between the first stage and second stage and the second stage turbine disc 12 via the discharge ports 28 in the dovetail of the second stage blade 22. The coolant in the cavity 33 flows into the coolant recovery path 8 via slits 44 formed on the rear stacking plane of the spacer disc 15 between the first stage and second stage and is discharged from the coolant recovery port 6 via the stub shaft 2.

Figure 4:
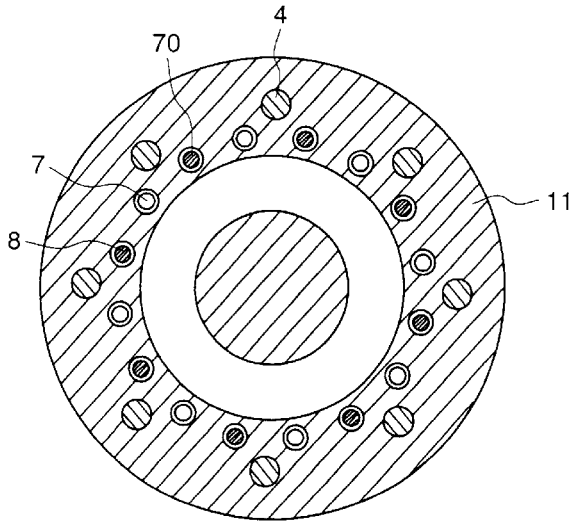
FIG. 4 is a side elevation of X—X section in FIGS. 2 and 3 as viewed from rear side.

FIG. 4 is a side elevation of the X—X section in FIGS. 2 and 3 as viewed from rear side.

On relatively outer periphery side of each disk shaped member, eight stacking bolts 4 are uniformly arranged in circumferential direction. Respectively eight coolant supply paths 7 and coolant recovery paths 8 are alternately formed in circumferential direction through the disc shaped members.

On the other hand, in FIG. 4, for reducing thermal stress and thermal deformation due to temperature difference between the coolant flow paths 7 and 8, the foregoing heat resisting pipe 70 is inserted into all of the coolant flow paths formed in the disc shaped members.

Returning to FIG. 1, the operation of the shown embodiment will be discussed.

The ring-shaped projecting portion 71 integrally formed on the rear end portion of the heat resisting pipe 70 is constrained in the diametrical direction by engagement with the spot facing recess 76. On the other hand, the ring shaped projecting portion 71 is constrained in axial direction as being tightly pinched between the side surface 76*f* of the spot facing recess 76 and the spacer disc 15 between the first stage and second stage. Accordingly, the heat resisting pipe 70 is secured in diametrical direction and axial direction and is restricted movement in diametrical direction and axial direction even in the case where the large flow rate of coolant 61 flows in the heat resisting pipe 70 upon operating rotation of the turbine rotor 1.

On the other hand, the inner peripheral surface 72 of the first stage turbine disc 11 and the heat resisting pipe 70 are contacted over the entire periphery direction by the front end portion of the heat resisting pipe 70 and engaging projecting portions 75 provided at two portions of the center portion in the axial direction. In the most portion other than two portions of the engaging projecting portions 75, a gap 73 is defined in radial direction between the heat resisting pipe 70 and the inner peripheral surface 72 for restricting heat transmission from inside of the heat resisting pipe 70 to the first turbine disc 11 by heat insulation effect in the diametrical gap 73. By this, occurrence of non-uniform thermal stress and thermal deformation in circumferential direction of the first stage turbine disc 11 can be restricted to reduce leakage amount of the coolant 61 between the first stage turbine disc 11 and the spacer disc 15 between the first stage and second stage from the coolant supply paths 7.

On the other hand, when breakage of the heat resisting pipe 70 is caused upon actuating rotation of the turbine rotor 1, and when rapture is caused at the boundary between the pipe body portion and the ring shaped projecting portion 71 where strength of the heat resisting pipe is the smallest, the ring shaped projecting portion 71 is restricted movement as being pinched between the side surface 76*f* of the spot facing recess 76 of the first stage turbine disc 11 and the front stacking plane of the spacer disc 15 between the first stage and second stage. On the other hand, the main body portion of the heat resisting pipe 70 is restricted movement by contacting to the projecting step portion 81 provided in the front opening portion of the coolant supply paths 7.

Figure 5:
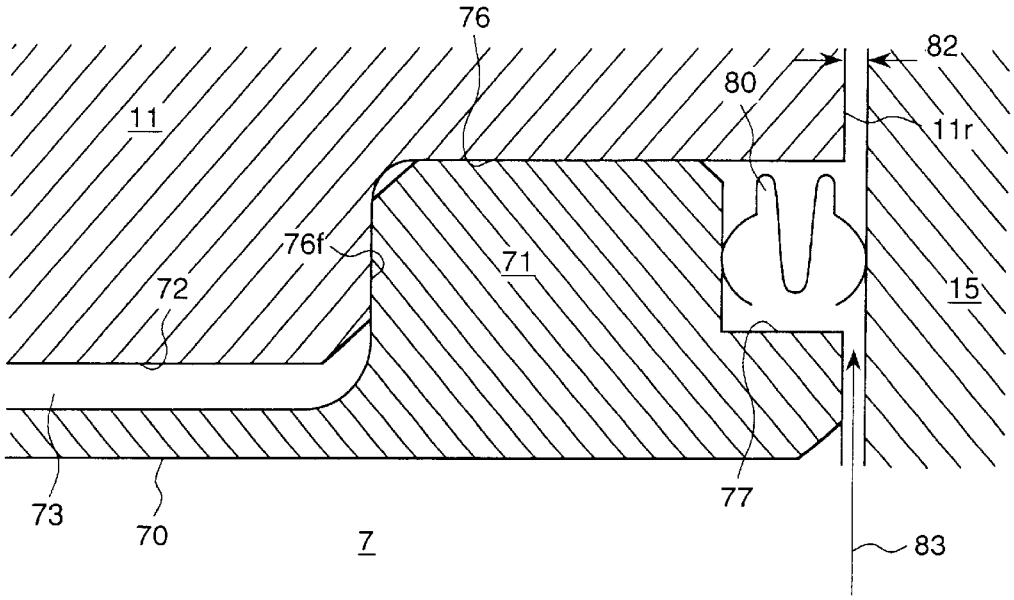
FIG. 5 is an enlarged illustration of a portion C in FIG. 1.

Next, FIG. 5 is an enlarged illustration of the portion C in FIG. 1. A sealing structure of the shown embodiment will be discussed in detail with reference to FIG. 5.

Between the stacking planes of the first turbine disc 11 and the spacer disc 15 between the first stage and second stage, it is inherent to cause certain gap due to tolerance in production and thermal deformation. Since the pressure in the coolant supply paths 7 is higher than that of the adjacent coolant recovery paths 8, the coolant 61 leaks to the stacking plane from the coolant supply paths 7 through the gap 82 and then to the adjacent coolant recovery paths 8. For restricting this, E-type elastic body which is elastically deformable, is provided.

In the shown embodiment, high chrome steel is used as the material of the disc shaped member and nickel-base forged super alloy is used as material of the heat resisting pipe 70 (including the ring shaped projecting portion 71). On the other hand, an E-type sealing member 80 is installed in the cut-out step portion 77 on the outer periphery of the ring shape projecting portion 71 of the heat resisting pipe 70 and is disposed between the cut-out step portion 77 and the spacer disc 15 between the first stage and second stage in the axial direction to sealingly contact therewith. By flow of the coolant at a temperature about 250 C. through the coolant supply paths 7, the heat resisting pipe 70 (including the ring shaped projecting portion 71), the first stage turbine disc 11 and the spacer disc 15 between the first stage and second stage cause thermal expansion. Nickel-base forged super alloy used in the heat resisting pipe 70 has higher linear thermal expansion coefficient in comparison with high chrome steel using the spacer disc 15 between the first stage and second stage. Therefore, the heat resisting pipe 70 and the ring shaped projecting portion 71 expands due to thermal expansion in greater magnitude than the first stage turbine disc 11 and the spacer disc 15 between the first stage and second stage. Since the front side surface of the ring shaped projecting portion 71 contacts with the side surface 76*f* of the spot facing recess 76 of the first stage turbine disc 11, the ring shaped projecting portion 71 expands rearwardly in axial direction by thermal expansion. As a result, the E-shaped seal member 80 is urged onto the front stacking plane of the spacer disc between the first stage and second stage to tightly contact therewith.

With the embodiment set forth above, even with the heat resisting pipes 70 divided per the disc shaped member, it can be fixed in diametrical direction and axial direction upon actuating rotation of the turbine rotor 1 to prevent wearing and damaging due to movement.

On the other hand, by restricting occurrence of non-uniform thermal stress and thermal deformation caused in the circumferential direction of the disc shaped member and by tight contact of the E-type seal member 80 with the turbine disc and the spacer disc, sealing performance between the turbine disc and the spacer disc can be improved to restrict the leakage amount of the coolant to be minimum. By restriction of leakage amount of the coolant, the predetermined flow rate of coolant can be supplied to the blade to avoid thermal unbalance of the turbine disc and the spacer disc by reducing leakage from the coolant supply paths 7 to the coolant collection paths 8.

On the other hand, the shown embodiment can form a relatively simple shape sealing structure with smaller number of machining portions can be formed by effectively using the fastening structure of the heat resisting pipe without providing particular groove for sealing on the surface of the turbine disc and the spacer disc. Therefore, extra stress concentration on the disc shaped member can be avoided and thus is advantageous in strength. On the other hand, since the heat resisting pipe 70 can be easily machined in comparison with the disc shaped member, it is also advantageous in lowering of production cost.

Also, in the shown embodiment, even when rupture is caused in the heat resisting pipe 70 due to local cracking, the separated portion is restricted movement by the projecting step portion 71 to be prevented from loosing out from the disk shaped member to avoid unbalance vibration due to offsetting of the gravity center of the disc. On the other hand, it becomes possible to prevent damaging of other parts by the loosing out separated portion for improving reliability.

While the shown embodiment employs different materials in forming the disc shaped member and the heat resist pipe (including the ring shaped projecting portion 71), the E-type seal member 80 can be applied even in the case when the same material or when the material having higher linear thermal expansion coefficient is used in the turbine disc is used. In such case, even when the turbine disc causes expansion rearwardly in axial direction in greater magnitude in the turbine disc, the ring shaped projecting portion 71 is also depressed rearwardly to improve sealing performance by tightly fitting the E-shaped seal member 80 onto the front stacking plane of the spacer disc.

It should be noted that the foregoing discussion for the shown embodiment has been given only for the construction around the coolant supply paths 7 in the first stage turbine disc 11. However, the shown embodiment is applicable for the same construction to all disk shaped member and all coolant flow paths (including the coolant recovery path) for obtaining similar effect. In such case, in relation to assembling step of the turbine rotor 1 as set forth above, each spot facing recess 76 is formed on the rear stacking plane of the disc shaped member and each ring shaped projecting portion 71 is formed on the rear side of the main body of the heat resisting pipe 70.

Also, the projecting step portion 71 is not limited to the construction where it is provided in only first stage turbine disc 11 but can be provided in any disc shaped member. By this, the separated portion of the heat resisting pipe 70 is certainly fixed per each disc shaped member to improve reliability.

It should be noted that, in the shown embodiment, while the annular seal member having E-shaped cross-section is used, the present invention is not limited to the shown construction but the annular seal member of other cross-section shape can be used.

Figure 6:
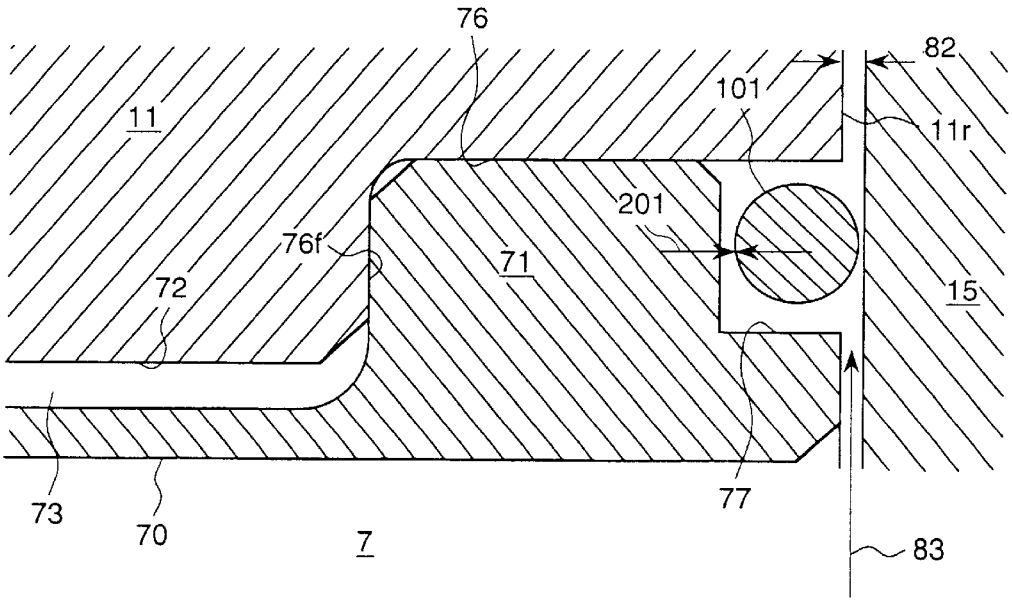
FIG. 6 is an illustration of a portion C in FIG. 1, in which a wire of solid circular cross-section is employed as an annular seal member.

For example, FIG. 6 is an enlarged illustration of the portion C in FIG. 1. FIG. 6 shows an alternative embodiment, in which a wire 101 of solid circular cross-section is used as the annular seal member.

Even with this construction, sealing function in certain extent can be obtained. However, the solid circular wire 101 lacks elasticity for a force applied in the axial direction and has high rigidity. Therefore, in viewpoint of strength between the wire 101 and he ring shaped projecting portion 71, a gap in axial direction has to be preliminarily provided between the wire 101 and the ring shaped projecting portion 71 to lower sealing performance in the extent that the coolant 61 passes through the gap 201.

Figure 7:
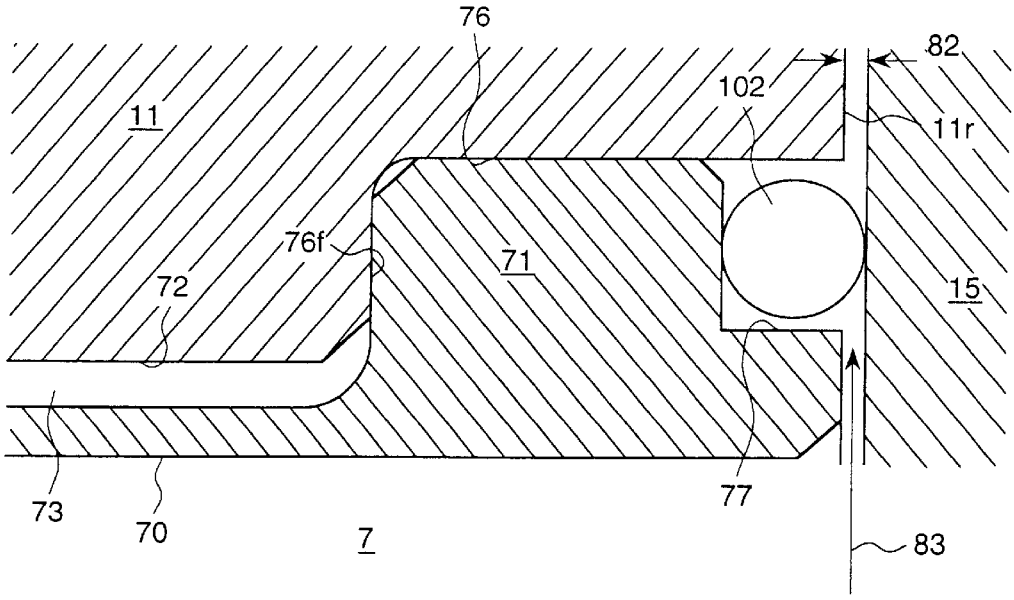
FIG. 7 is an illustration of a portion C in FIG. 1, in which a cross-sectionally O-shaped (follow circular) one is employed as the annular seal member.

FIG. 7 is an enlarged illustration of the portion C in FIG. 1. FIG. 6 shows an alternative embodiment, in which the annular seal member of O-shaped (hollow circular shaped) cross-section is used.

Such O-shaped seal member 102 has elasticity in axial direction and can be installed between the ring shaped projecting portion 71 and the spacer disc 15 between the first stage and the second stage with tightly fitting therewith and without causing problem in strength. Also, even upon occurrence of thermal expansion of the heat resisting pipe 70, the O-shaped seal member 102 can maintain high sealing performance by causing elastic deformation following to the thermal expansion.

Figure 8:
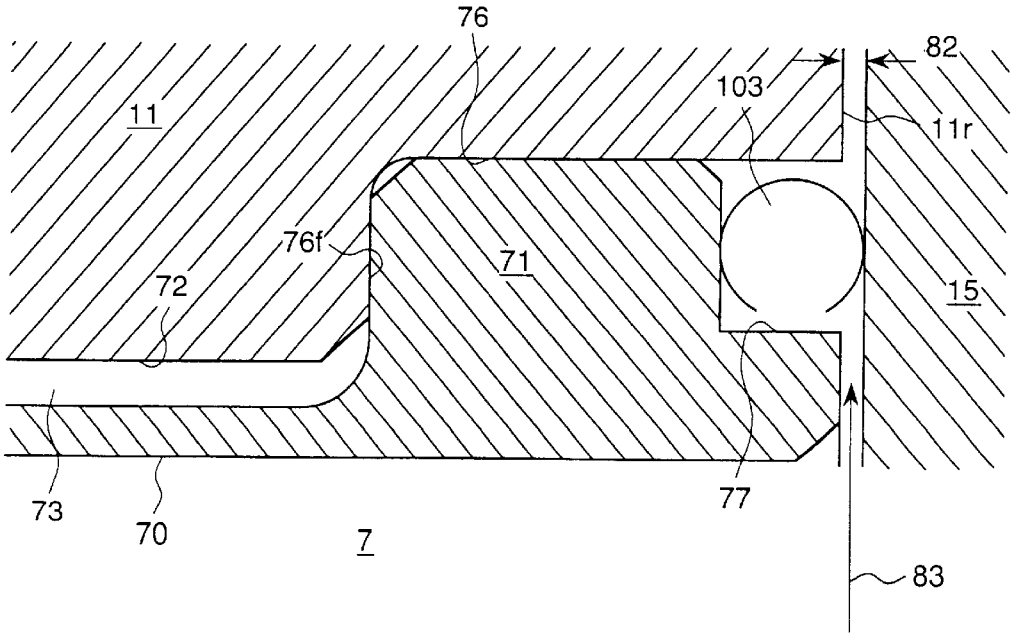
FIG. 8 is an illustration of a portion C in FIG. 1, in which a cross-sectionally C-shaped (follow circular) one is employed as the annular seal member.

FIG. 8 is an enlarged illustration of the portion C in FIG. 1. FIG. 6 shows an alternative embodiment, in which the annular seal member of C-shaped (hollow circular shaped) cross-section is used.

Such C-shaped seal member 103 has elasticity and can be installed between the ring shaped projecting portion 71 and the spacer disc 15 between the first stage and the second stage with tightly fitting therewith. Also, even upon occurrence of thermal expansion of the heat resisting pipe 70, the O-shaped seal member 102 can maintain high sealing performance by causing elastic deformation following to the thermal expansion.

Furthermore, when the C-shaped seal member 103 is employed, and when the seal member 103 is provided in the coolant supply paths 7 shown in FIG. 1, for example, coolant 83 leaked between the ring shaped projecting portion 71 and the spacer disc 15 between the first stage and second stage flows into inside of the C-shaped sealing member 103 to expand the inside to provide further elastic force. Accordingly, the C-shaped seal member 103 improves sealing performance by contacting further tightly to the spacer disc 15 between the first stage and second stage and the ring shaped projecting portion 71.

Figure 9:
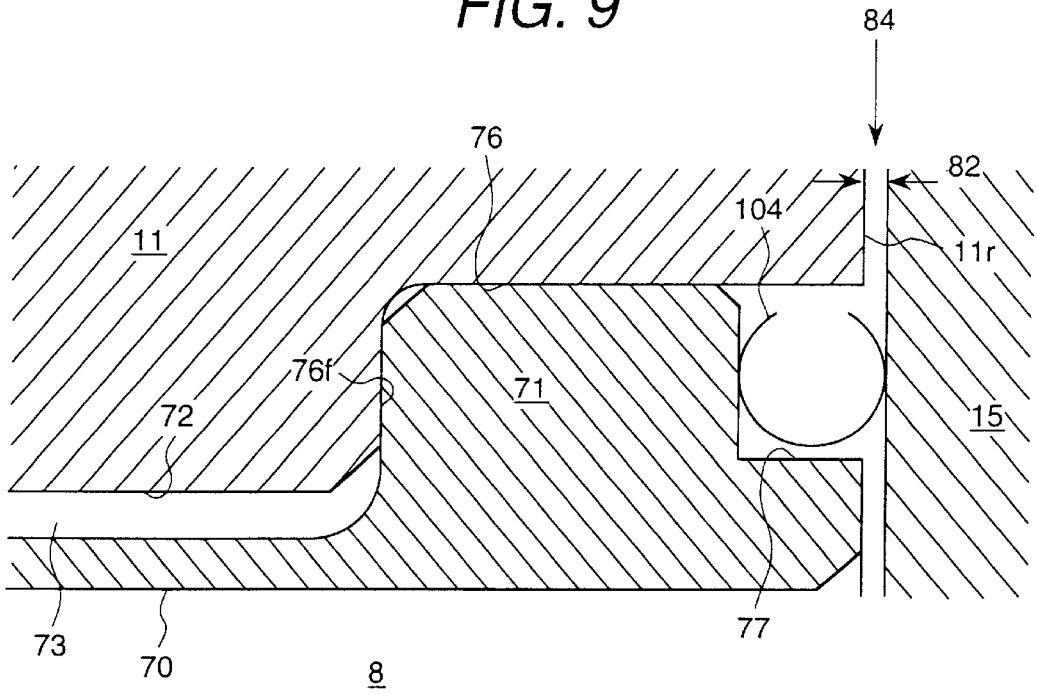
FIG. 9 is an enlarged illustration of the case where the C-type seal member is employed in a coolant recovery path.

On the other hand, upon obtaining sealing performance set forth above by installing the C-shaped seal member within the coolant recovery path 8, it is required to orient the opening portion in cross-sectional shape outwardly as shown in FIG. 9. The reason is that since the pressure of the coolant 62 in the coolant recovery path 8 is lower than that of the coolant 61 in the coolant supply path 7, direction of leakage 84 of the coolant in the stacking plane is constantly from the coolant supply path 7 to the coolant recovery path 8.

Figure 10:
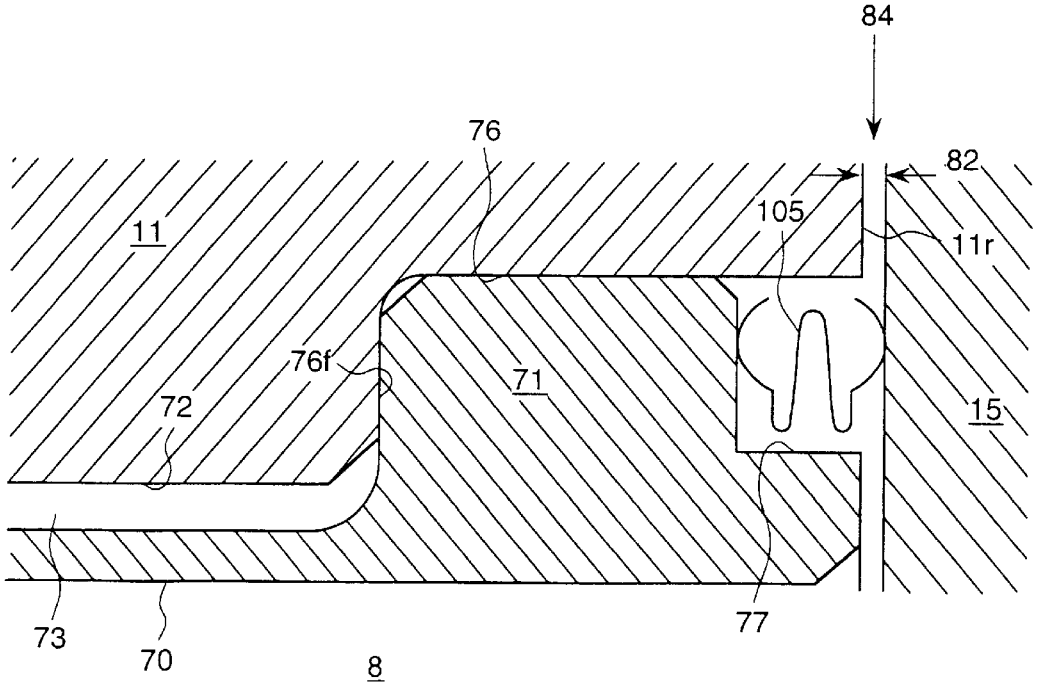
FIG. 10 is an enlarged illustration of the case where the E-type seal member is employed in a coolant recovery path.

Similarly, when the E-shaped seal member is installed in the coolant recovery path 8, for in flowing the coolant into the E-shaped seal member, it desirable that the opening side of the E-shaped seal member 105 has to be oriented toward outside as shown in FIG. 10.

Figure 11:
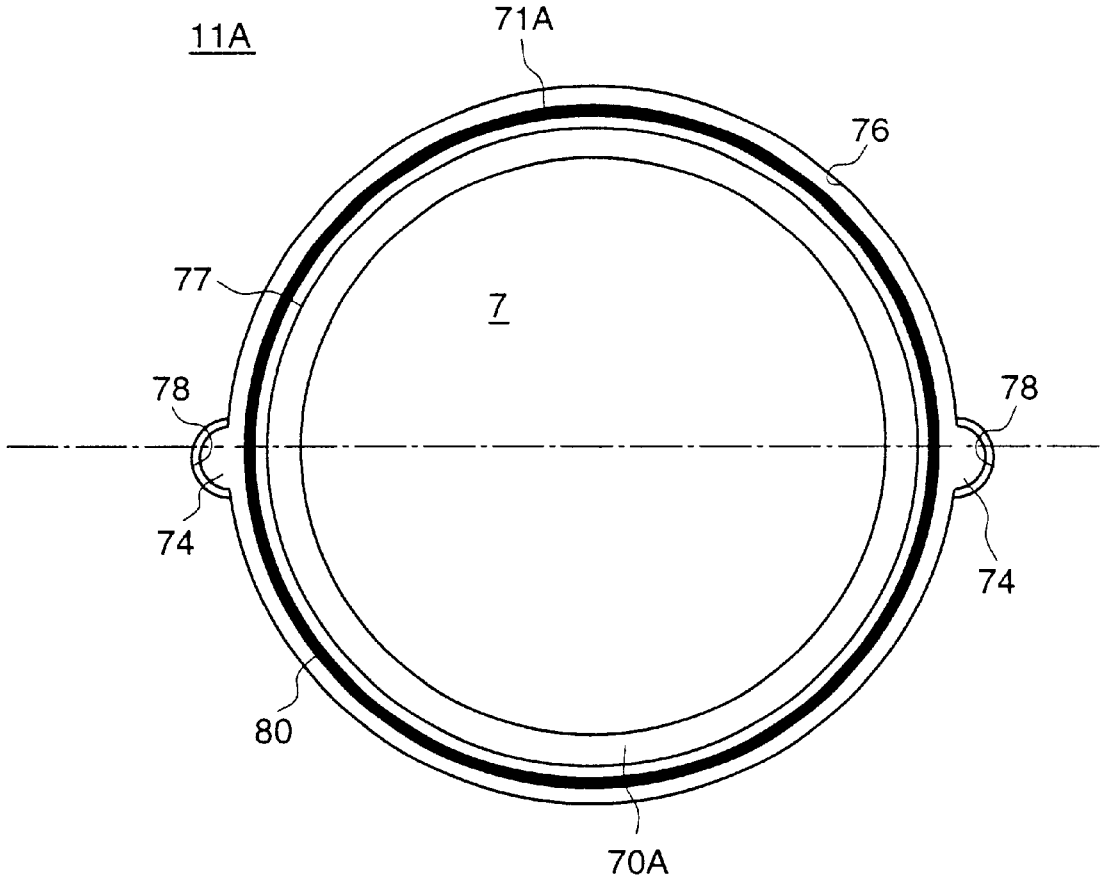
FIG. 11 is a side elevation of the condition where the annular seal member and the heat resisting pipe are installed within one of the coolant supply paths in the second embodiment of the turbine rotor according to the present invention.

The second embodiment of the turbine rotor according to the present invention will be discussed with reference to FIG. 11. FIG. 11 is a side elevation of the shown embodiment of the turbine rotor according to the present invention in a condition where the annular seal member and the heat resisting pipe are installed on one of the coolant supply paths 7 of the first stage turbine disk, as viewed from the rear side.

In FIG. 11, on the outer peripheral surface of the ring-shaped projecting portion 71A of the heat resisting pipe 70, identical shape of projections 74 are provided at two positions located symmetrically with respect to the center axis. On the rear stacking surface of the first stage turbine disk 11A, back facing grooves 78, to which respective projecting portions 74 are engageable on the peripheral positions, to respectively of which two projecting portions 74 match on the outer periphery of the spot facing recess 76A.

With the embodiment constructed as set forth above, upon operating revolution of the turbine rotor, even when centrifugal force act on the heat resisting pipe 70A, displacement or rotation of the heat resisting pipe 70A is entirely fixed in circumferential direction by engagement of the projecting portions with the back facing groove 78. Accordingly, wearing and/or damaging of the heat resisting pipe 70A (including the ring shaped projecting portion 71) and the annular seal portion can be restricted to improve reliability of seal performance.

With the present invention, the ring shaped projecting portions are restricted from movement in diametrical by engagement with the spot facing recess, and the ring shaped projecting portion is sandwiched in axial direction with two disc shaped members, the heat resisting pipe is fixed in the diametrical direction and axial direction even during operating revolution of the turbine rotor to prevent the heart resisting pipe from wearing or being damaged.

Also, with the present invention, since the seal structure is provided utilizing the fixing structure on the side of the pipe without providing particular machining for the disc member. Therefore, leakage from the coolant flow path to the stacking plane can be reduced with avoiding increasing of stress concentration due to machining.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

What is claimed is:

1. A turbine rotor comprising:

a coolant flow path formed through a plurality of disc shaped members respectively stacked across stacking planes in axial direction;

a heat resisting pipe divided into a plurality of fractions adapted to be inserted into a portion of said coolant flow path defined in each disc shaped member;

spot facing recesses each formed at opening portion of coolant flow path at the same side of said disc shaped member coaxially with said coolant flow path and having greater inner diameter than said opening portion; and ring shaped projecting portions formed at respective end portions of said fractions of said heat resisting pipe and contacting with with respective spot facing recesses.

2. A turbine rotor as set forth in claim 1, wherein each of said ring shaped projecting portions is formed with a cut-out step portion on the side of said stacking plane for receiving therein an annular seal member.

3. A turbine rotor as set forth in claim 2, wherein a material of said heat resisting pipe has greater linear thermal expansion coefficient than that of a material of said disk shaped member.

4. A turbine rotor as set forth in claim 1, wherein at least two projecting ridges are provided on outer periphery of said ring shaped projecting portion, and back facing grooves engageable with said projecting ridges are formed on the inner periphery of said spot facing recess at circumferential positions corresponding to positions of said projecting ridges.

5. A turbine rotor as set forth in claim 1, wherein a engaging projecting portions having smaller inner diameter than that of said coolant flow path is formed the end of said heat resisting pipe on opposite side of the end where said ring shaped projecting portion is provided, said engaging projecting portions is located in an opening portion of said coolant flow path on the stacking plane of said disc shaped member on opposite side of said stacking plane where said spot facing recess is formed.

* * * * *